US006065177A

United States Patent [19]

Chien

[11] Patent Number: 6,065,177

[45] Date of Patent: May 23, 2000

[54] STRUCTURE OF A BATHING TOWEL

[76] Inventor: Kuo-Ching Chien, No. 7,Lane 74, Kung-Wu Road, Lung-Tan, Taiwan

[21] Appl. No.: 09/118,939

[22] Filed: Jul. 20, 1998

[51] Int. Cl.[7] ..... A47K 7/02

[52] U.S. Cl. ..... 15/227; 15/209.1; D28/63

[58] Field of Search ..... D28/63; D6/522; 401/200, 201; 15/209.1, 210.1, 227

[56] References Cited

U.S. PATENT DOCUMENTS

| | | | |
|---|---|---|---|
| 686,638 | 11/1901 | Saffold | 15/227 |
| 1,351,311 | 8/1920 | Virneburg | 401/201 |
| 2,745,128 | 5/1956 | Zeuner | 15/227 |
| 3,661,690 | 5/1972 | Taranto | 15/227 |
| 4,893,372 | 1/1990 | Wenzel | 15/227 |
| 5,127,127 | 7/1992 | Jarosinski | 15/227 |

FOREIGN PATENT DOCUMENTS

| | | | |
|---|---|---|---|
| 261274 | 6/1960 | Australia | 15/227 |
| 509812 | 3/1952 | Belgium | 15/209.1 |
| 325655 | 2/1930 | United Kingdom | 15/227 |

*Primary Examiner*—Randall E. Chin
*Attorney, Agent, or Firm*—Bacon & Thomas

[57] ABSTRACT

An improved structure of a bathing towel, and especially a bathing towel which is suitably folded into the form of a bag for placing therein utensils such as a perfumed soap, a bathing brush or bathing balls etc., the bathing towel is provided at a first corner and on the front and bottom surfaces thereof respectively with an engaging button, and is provided at the right and left corners thereof each with a buckling hole, and a buckling ring is provided at the opposite corner to the first corner, the corner with the engaging buttons of the bathing towel is folded upwardly, then the right and left corners of the bathing towel having buckling holes are folded upwardly to lap over and engage with one of the engaging buttons, the bathing towel thus forms a bag for receiving therein bathing utensils such as a perfumed soap, bathing balls, a bathing brush or a toy of a child etc., the buckling ring can be hung on a hook to reduce occupation of space on a towel hanger; when the bathing towel is not in use, the bathing utensils can be well placed therein and hung on a hook.

6 Claims, 10 Drawing Sheets

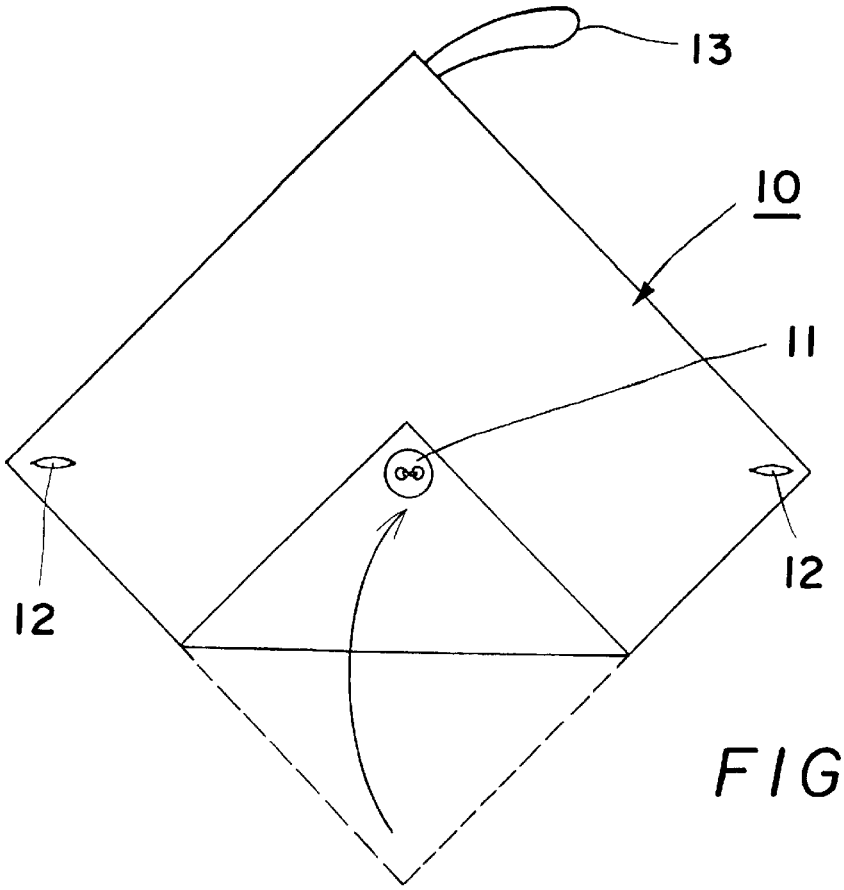
FIG. 2
FIG. 3
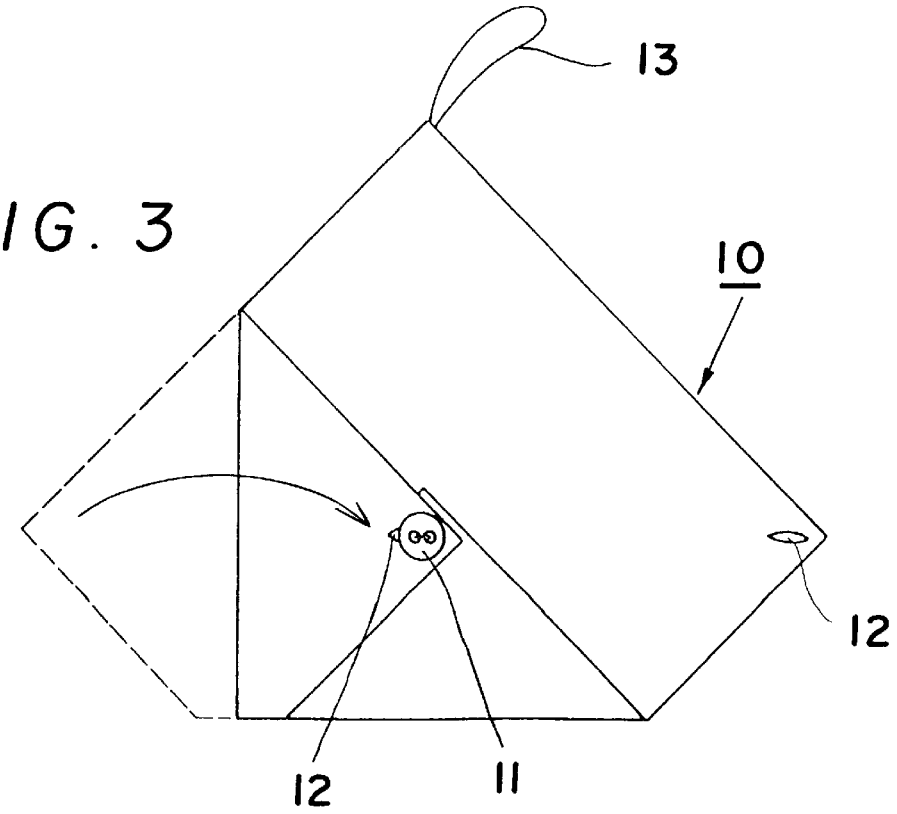

STRUCTURE OF A BATHING TOWEL

BACKGROUND OF THE INVENTION

1. Field of the Invention

The present invention relates to an improved structure of a bathing towel, and especially to an improved structure of a bathing towel which is suitably folded into the form of a bag for placing therein a soap, brush or a bathing utensil, engaging buttons and buckling holes are provided on the bathing towel, the towel is folded to form a bag shape for placing therein a bathing utensil or for inserting therein a hand to grasp the towel for wiping the body of oneself, hence the towel can have multiple functions.

2. Description of the Prior Art

A towel is necessarily used for washing a face and wiping a body etc. in bathing, it is a soft thin sheet, it must be supported or stretched by a hand when in use, and is unfolded and hung on a towel hanger after use, beside these, it does not have other function; length of a common towel hanger is quite limited, three or four towels may fully occupy the available length, in a family having more members, towels can not be well stretched out for hanging, and some make the towels be lapped one over another and may make a mess, a bath room may thereby look unneat and ugly; while bathing towels have been being necessary bathing utensils, they are not propable to be substituted well enough, placement and disposing of them have been being a problem for long, yet people can not do something to it, the problem is supposed to be solved as fast as possible in order that bathing towels can be more conveniently used, more easily stored or more well used.

Generally in bathing, bathing utensils beside bathing towels, such as perfumed soaps, bathing brushes and bathing balls etc. are used, and toys for children always occupy space in a bath room too, these articles normally do not have a specified area for placing and are separately put at the corners of the bath room, so that the bath room is in a mess, disposing of the various bathing utensils thus is a trouble too.

SUMMARY OF THE INVENTION

In view that bathing towels are very important bathing utensils, they are needed any time in bathing, while conventional bathing towels are used for nothing but washing faces or wiping bodies, and are space occupying when they are hung on a towel hanger after use, the inventor thereby provides the present invention based on his professional experience of years in designing, manufacturing and selling the similar products and after continuous study, improving and developing, as well as after multiple experiments, examinations and tests, wherein, bathing towels are provided with engaging buttons, buckling holes and buckling rings, the towels are folded to form bags for placing therein bathing utensils such as perfumed soaps and bathing balls etc.

The principal object of the present invention is to provide bathing towels which are provided at the corners thereof with engaging buttons, buckling holes and buckling rings, so that when the towels are folded to form bags, the engaging buttons are engaged with the buckling holes for placing therein bathing utensils such as a perfumed soap and bathing balls etc., in this way, the bathing towels are more practical in use, the buckling rings can be hung on hooks to reduce occupation of space on a towel hanger.

The secondary object of the present invention is to have the towels folded to form bags for inserting therein hands to be used as gloves for wiping and cleaning the body.

Another object of the present invention is to add coarser cloth on the surfaces of the bathing towels to increase friction of the bathing towels, so that they can suitably rub skins with larger frictional force.

The present invention will be apparent in its practical structure, characteristics and mode of using after reading the detailed description of the preferred embodiments thereof in reference to the accompanying drawings. Wherein:

BRIEF DESCRIPTION OF THE DRAWINGS

FIG. 2 is a schematic view of the present invention showing folding of a bathing towel;

FIG. 3 is a schematic view of the present invention showing further folding of the bathing towel;

DETAILED DESCRIPTION OF THE PREFERRED EMBODIMENT

Figure 1:
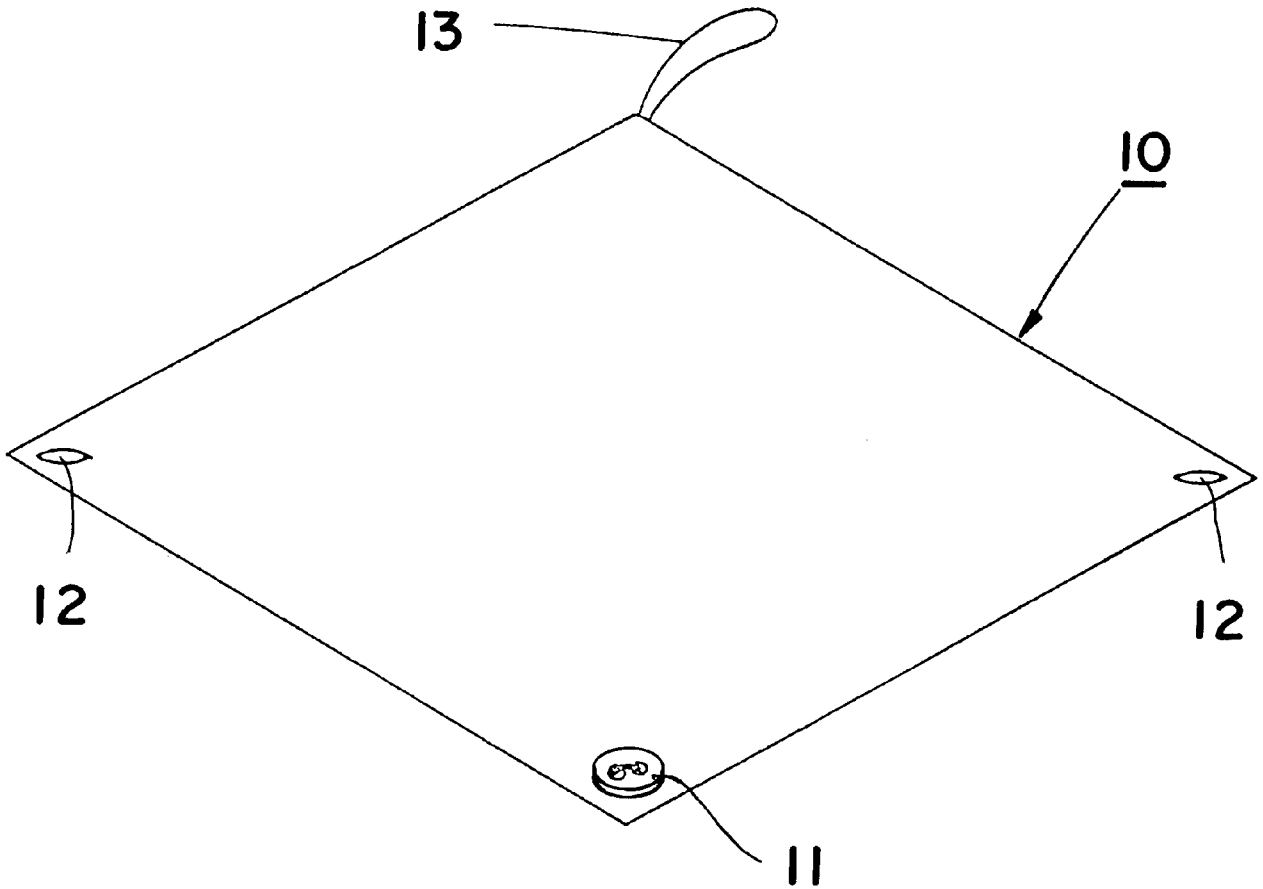
FIG. 1 is a schematic view showing the structure of a bathing towel of the present invention.
Figure 4:
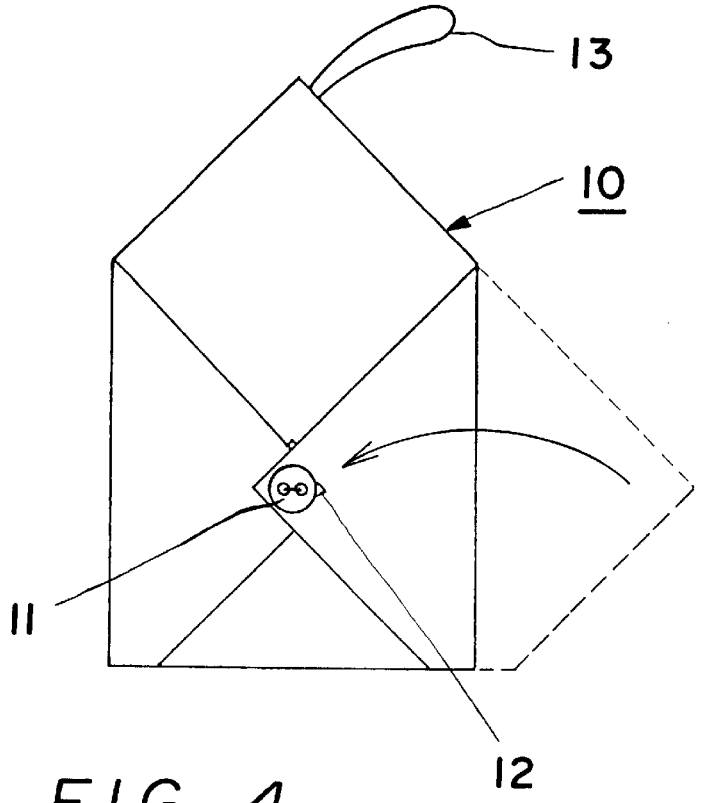
FIG. 4 is a schematic view of the present invention showing even further folding of the bathing towel.
Figure 5:
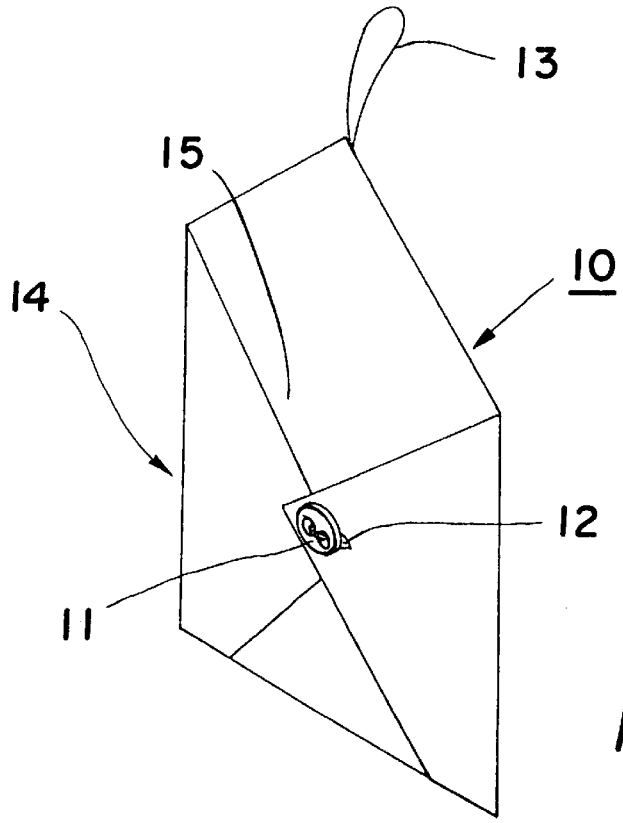
FIG. 5 is a schematic view of the present invention showing the bathing towel is in the shape of a bag after folding.

As shown in FIG. 1 of the drawings, a bathing towel 10 of the present invention is provided at the lower corner and on the front and bottom surfaces thereof respectively with an engaging button 11, and is provided at the right and left corners thereof respectively with a buckling hole 12, and a buckling ring 13 is provided at the opposite corner to the corner providing the engaging buttons 11, so that when the corner with the engaging buttons 11 of the towel 10 is folded upwardly (as shown in FIG. 2), the right and left corners of the towel 10 having buckling holes 12 are folded upwardly (as shown in FIGS. 3, 4) to lap over and engage with one of the engaging buttons 11, so that the bathing towel 10 forms a bag 14 (as shown in FIG. 5), a mouth 15 is provided on the bag 14, the shape of the bag 14 is kept when the bathing towel 10 is not in use, while when it is used, it needs only to unlock the buckling holes 12 from the engaging button 11 and the bathing towel 10 is ready for use.

Figure 6:
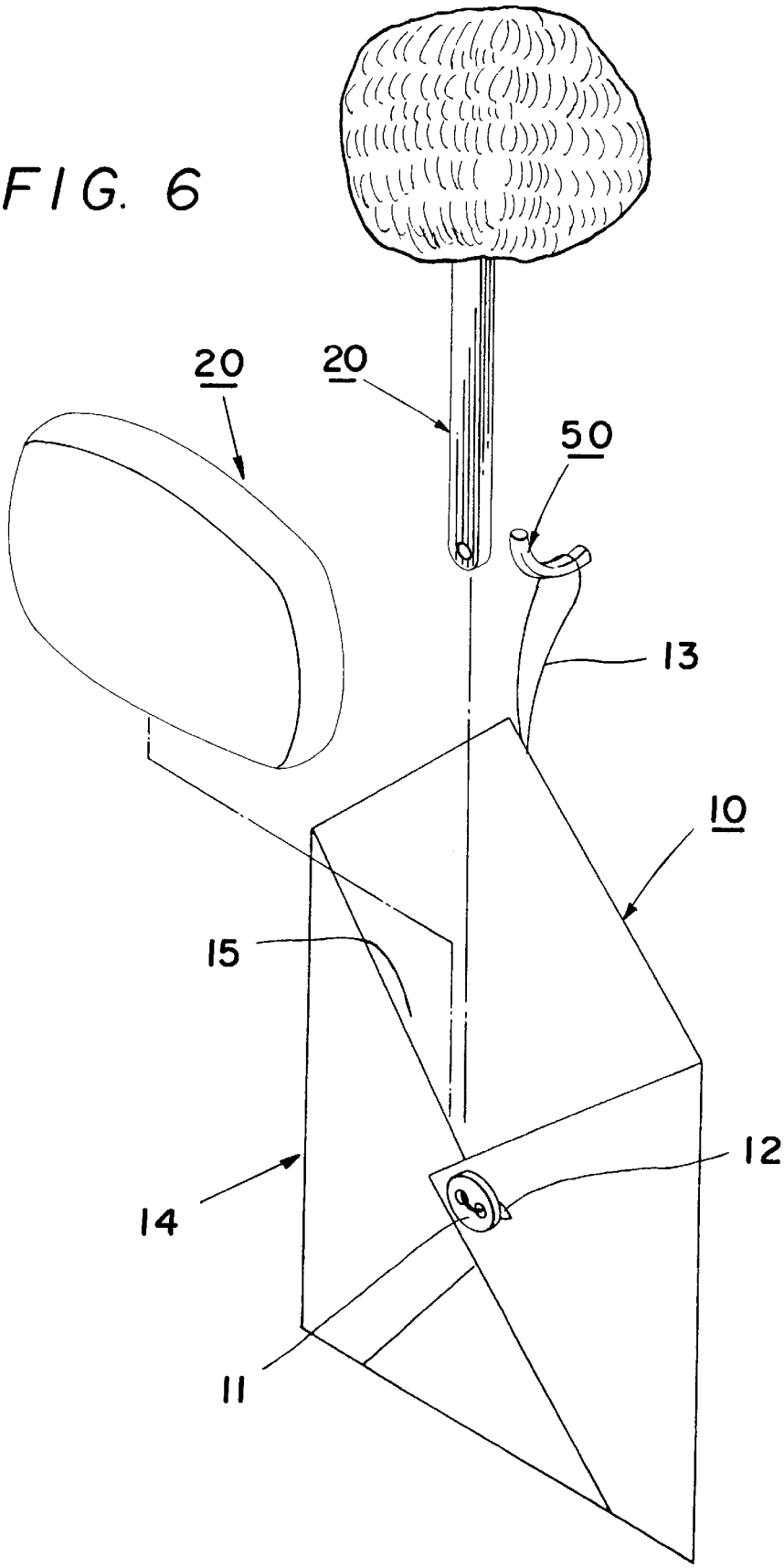
FIG. 6 shows an example of use of the bathing towel of the present invention.
Figure 7:
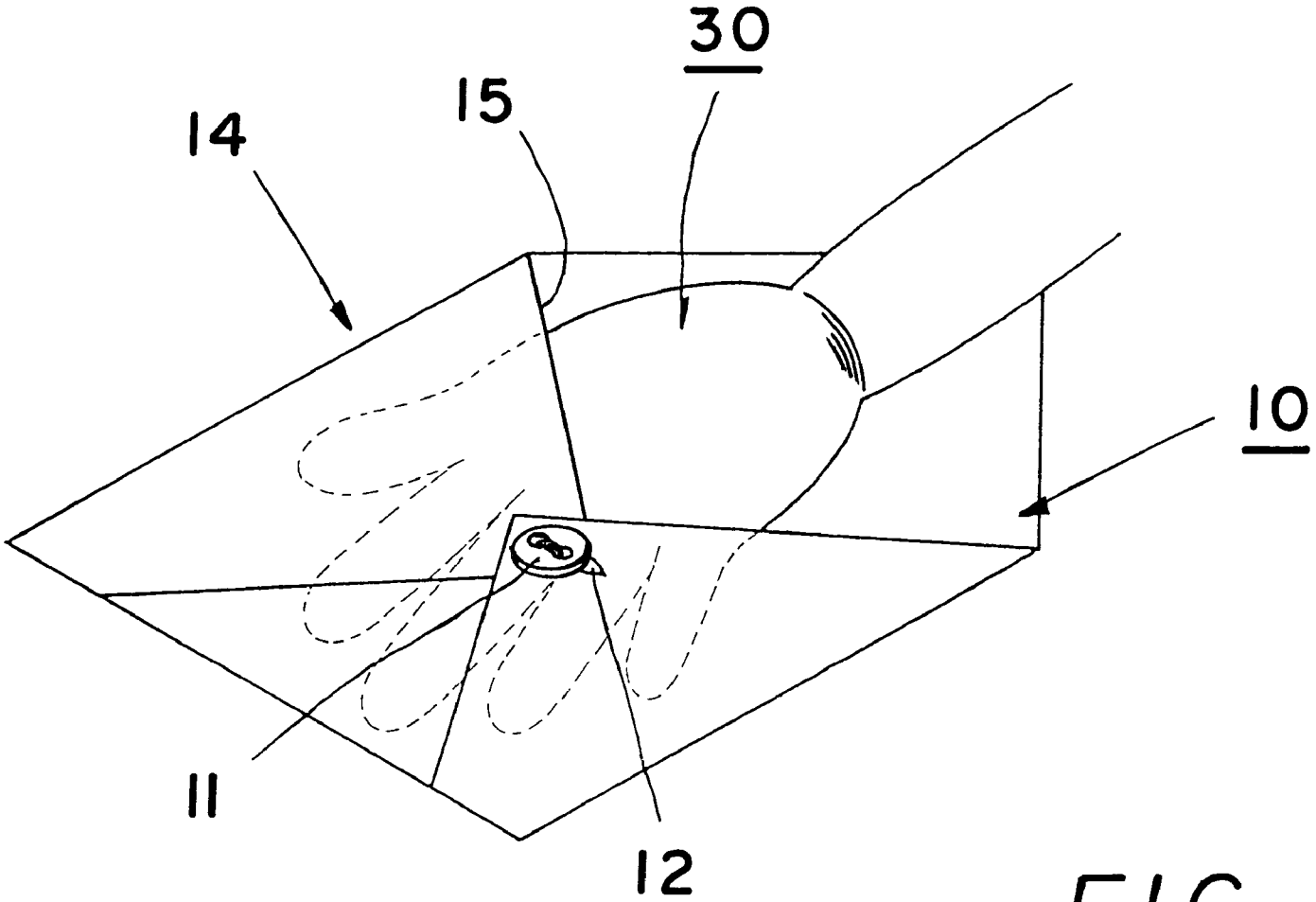
FIG. 7 shows another example of use of the bathing towel of the present invention.

Referring to FIG. 6 attached, after the bathing towel 10 of the present invention is folded into the form of the bag 14, the utensils 20 such as a soap, a bathing brush, bathing balls etc. or a toy of a child can be placed therein through the mouth 15, the bathing towel 10 then can be hung on a hook 50 by means of the buckling ring 13, hence the space that the bathing towel 10 occupies when in a strethced state can be saved, and parts of the utensils 20 are received in the bag 14, so that the parts of the utensils 20 can occupy no more space in the bathroom, therefore, the bathroom is tidier, and more comfortable; moreover, after the bathing towel 10 is folded into the form of the bag 14, a hand 30 can be extended into the mouth 15 to make the bathing towel 10 a form of a bathing glove, so that the hand 30 can hold the bathing towel 10 to brush and cleanse the body, thereby, the bathing towel 10 can have one more way and function of using.

Figure 8:
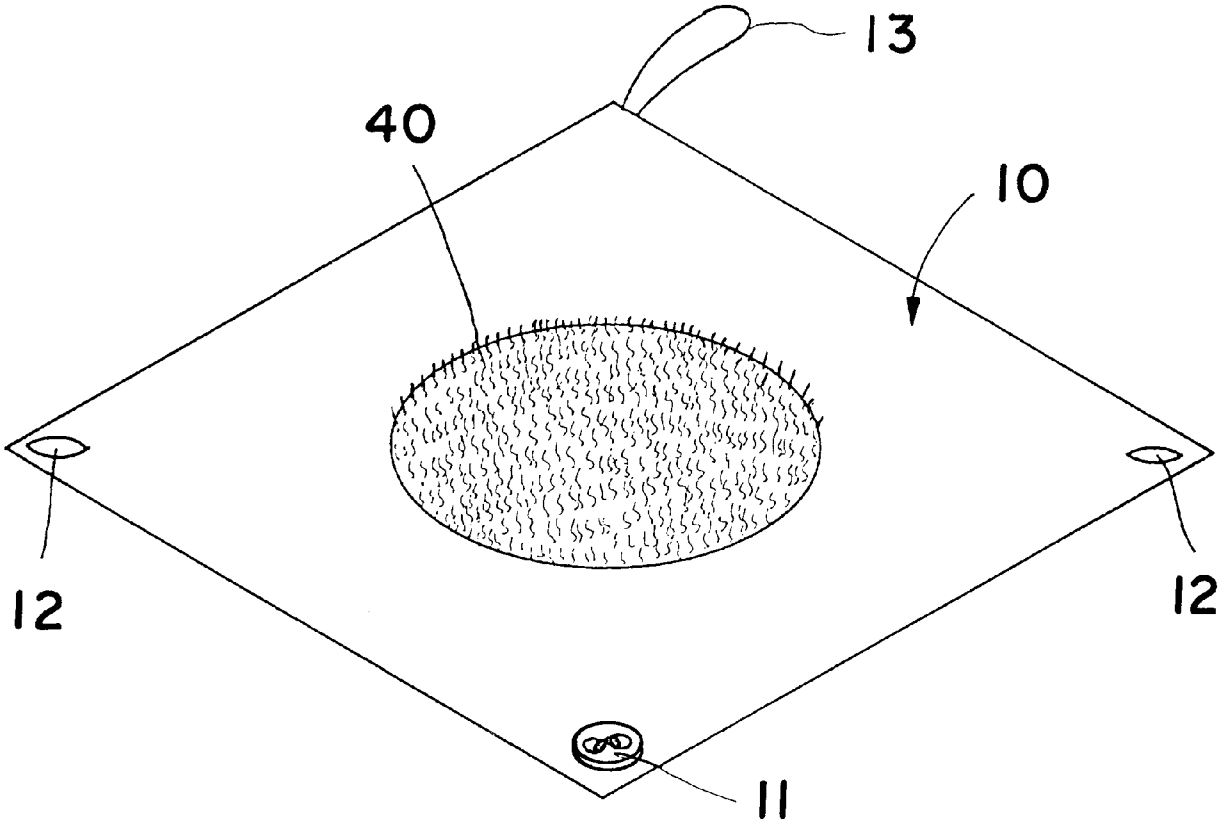
FIG. 8 shows another embodiment of structure of the bathing towel of the present invention.

Referring to FIG. 8 attached, the bathing towel 10 of the present invention is provided thereon with coarse material 40 (such as coarser cloth or raised granules) to increase friction force of the bathing towel 10, thus it is more effective in cleaning body, and the coarse material 40 provided thereon can give suitable rubbing action to the body, the bathing towel 10 can then have the functions of wiping and rubbing. The bathing towel 10 therefore can have more functions and ways of using.

Figure 9:
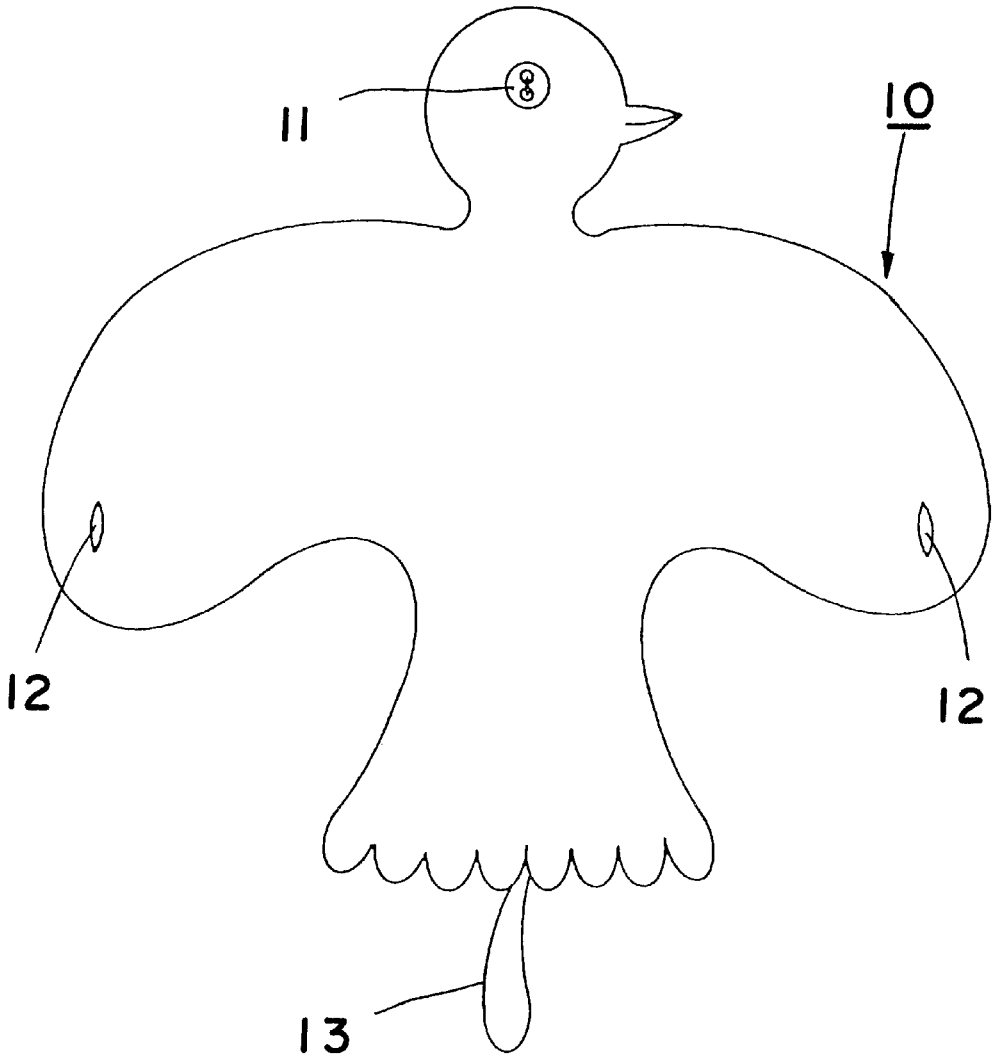
FIG. 9 shows another example of configuration of the bathing towel of the present invention.
Figure 10:
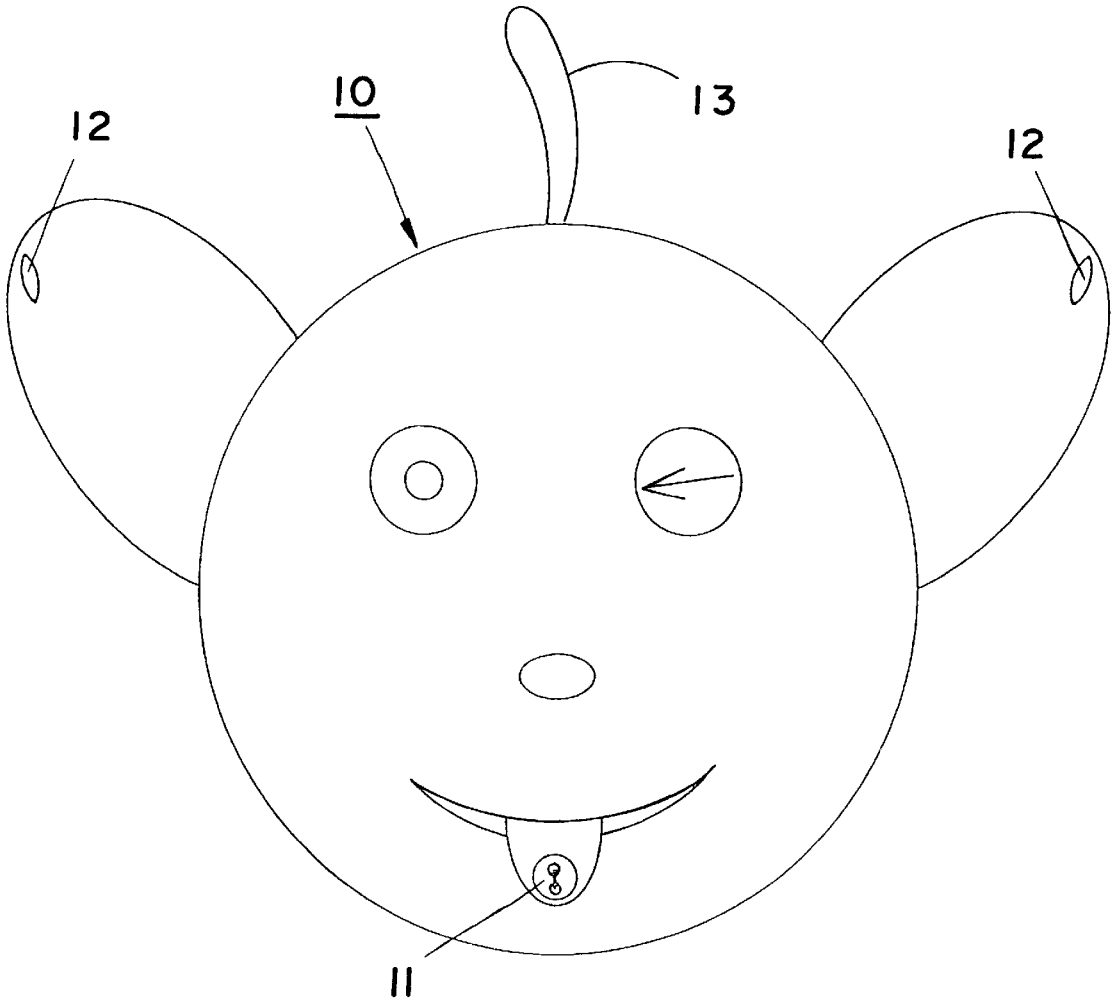
FIG. 10 shows a further example of configuration of the bathing towel of the present invention.
Figure 11:
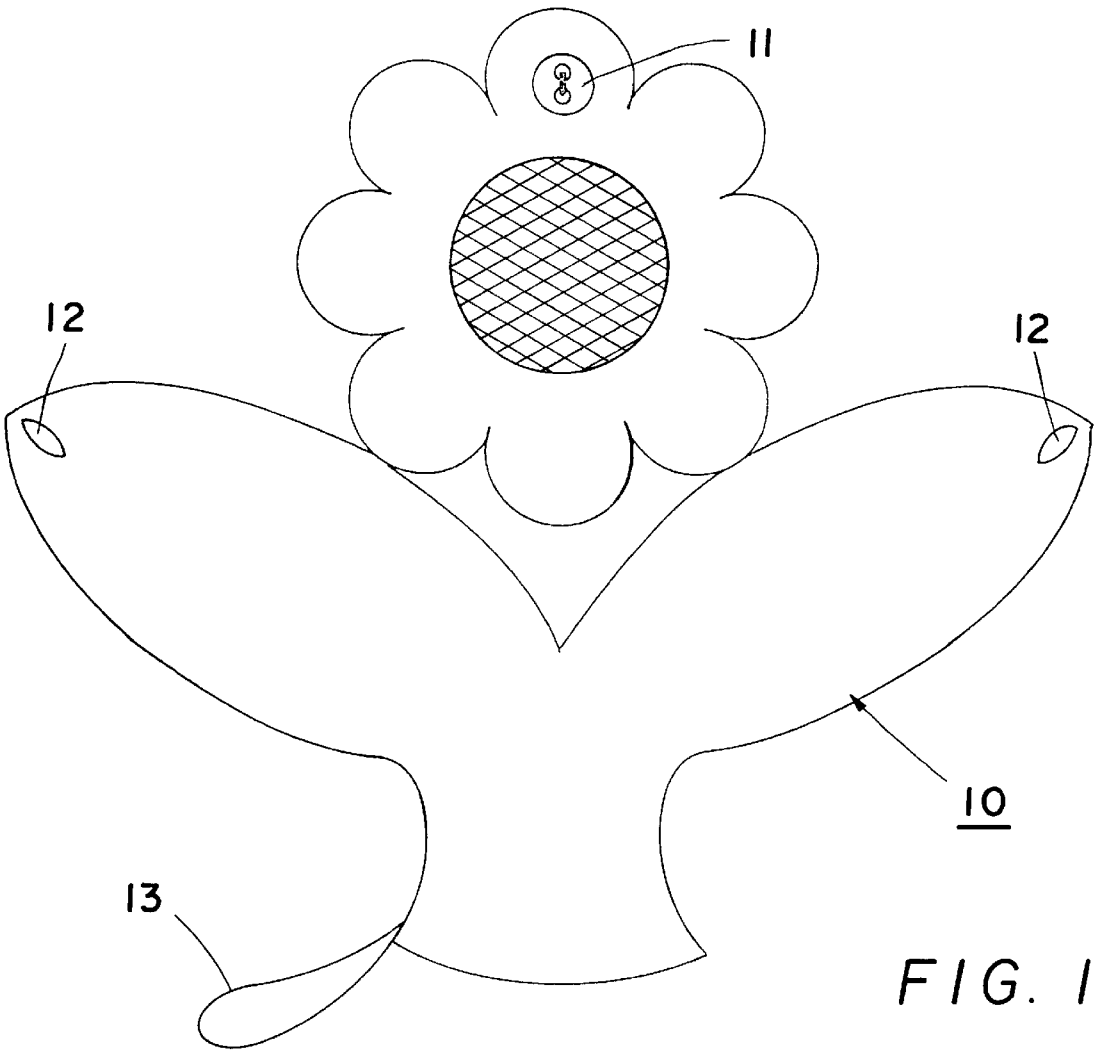
FIG. 11 shows a further example of configuration of the bathing towel of the present invention.
Figure 12:
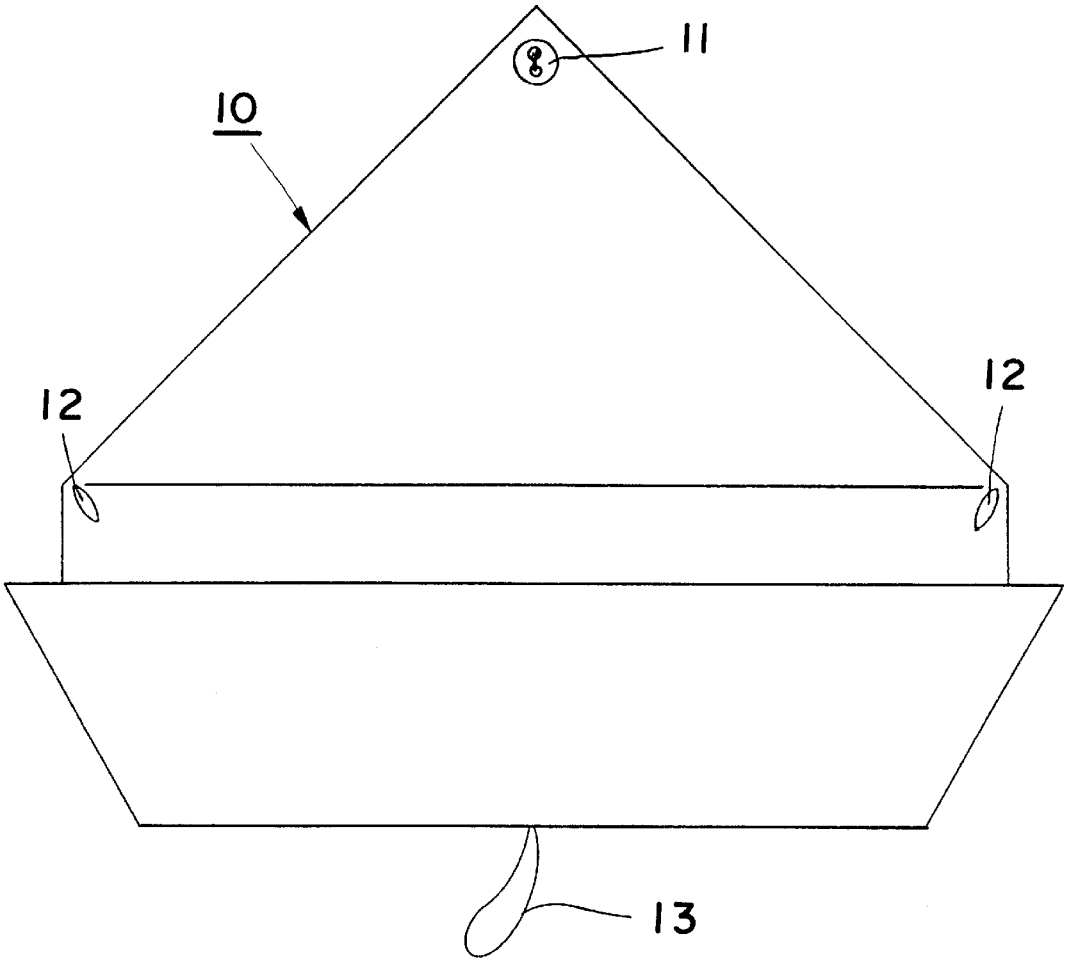
FIG. 12 shows one more example of configuration of the bathing towel of the present invention.

Referring to FIGS. 9, 10, each bathing towel 10 of the present invention is made the shape of an animal, the engaging buttons 11, the buckling holes 12 and the buckling ring 13 are appropriately located on the bathing towel 10, so that the animal shaped bathing towel 10 is folded to form a bag; the bathing towel 10 can also be made the shape of a plant (as shown in FIG. 11), or a traffic tool (as shown in FIG. 12), the bathing towel 10 can thus be made one of multiple shapes, this can increase fun and esthetic effect in bathing by using such a bathing towel 10.

As stated above, the present invention provides engaging buttons, buckling holes and a buckling ring on the bathing towel, by folding the bathing towel to form a bag, and a bathing utensil such as a soap, a bathing brush, bathing balls etc. can be placed in the bathing towel, or a hand can be inserted in the bathing towel to use the bathing towel as a glove, the bathing towel therefore can have more functions and ways of using, and bathing effect can thereby increased. Having thus described my invention with practicability and improveness, what I claim as new and desire to be secured by Letters Patent of the United States are:

1. An improved structure of a bathing towel comprised on said bathing towel a said at least one engaging button, a plurality of buckling holes and a buckling ring, being characterized in that:

said bathing towel is provided at a first corner and on a front and a bottom surface thereof respectively with said at least one engaging button, and is provided at a right and a left corner relative to said first corner respectively with one of said buckling holes, and said buckling ring is provided at the opposite corner to said first corner, said first corner with said at least one engaging button of said bathing towel is folded upwardly, then said right and left corners of said bathing towel having said buckling holes are folded upwardly to lap over and engage with said at least one engaging button, said bathing towel thus forms a bag; when said buckling holes are unbuckled from said at least one engaging button, said bathing towel restores its original form.

2. An improved structure of a bathing towel as stated in claim 1, wherein, said bathing towel is folded to form a bag to receive bathing utensils such as a perfumed soap, bathing balls etc. to increase available space for said utensils.

3. An improved structure of a bathing towel as stated in claim 1, wherein, said bathing towel is folded to form a bag to allow a hand to be inserted in said bathing towel to use said bathing towel as a glove.

4. An improved structure of a bathing towel as stated in claim 1, wherein, said bathing towel is provided thereon with coarse cloth or raised granules to increase friction force of said bathing towel and to give suitable rubbing action to the body of a person using said bathing towel.

5. An improved structure of a bathing towel as stated in claim 1, wherein, said bathing towel provided on said front and bottom surfaces thereof respectively with an engaging button is foldedable either in the front side or the bottom side thereof.

6. An improved structure of a bathing towel as stated in claim 1, wherein, said bathing towel is made one of various shapes.

* * * * *